US006545203B2

(12) United States Patent
Arimori

(10) Patent No.: US 6,545,203 B2
(45) Date of Patent: Apr. 8, 2003

(54) OPENING AND CLOSING ASSIST FOR A FRONT LID OF A KEYBOARD INSTRUMENT

(75) Inventor: Manabu Arimori, Hamamatsu (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 0 days.

(21) Appl. No.: 09/867,040

(22) Filed: May 29, 2001

(65) Prior Publication Data

US 2001/0047714 A1 Dec. 6, 2001

(30) Foreign Application Priority Data

May 29, 2000 (JP) ..... 2000-158188

(51) Int. Cl.[7] ..... G10C 3/02
(52) U.S. Cl. ..... 84/179
(58) Field of Search ..... 84/179, 178, 177, 84/174, DIG. 17

(56) References Cited

U.S. PATENT DOCUMENTS 5,056,396 A * 10/1991 Furukawa ..... 84/179
5,175,386 A * 12/1992 Kuwahara ..... 84/179
5,942,702 A * 8/1999 Inoue ..... 84/179
6,130,371 A * 10/2000 Inoue ..... 84/179

* cited by examiner

*Primary Examiner*—Kim Lockett
(74) *Attorney, Agent, or Firm*—Davis & Bujold, P.L.L.C.

(57) ABSTRACT

A front lid opening and closing assist which enables an easy and safe operation of opening and closing a front lid of a keyboard instrument. A buffer in the front lid opening and closing assist has a first damping mechanism for damping the front lid when pivoted from a neutral position to an open position, and a second damping mechanism for damping the front lid when pivoted from the neutral position to a closed position. When the front lid is pivoted beyond the neutral position, it spontaneously pivots toward the open or closed position by its own weight. However, this motion is damped by the first and second damping mechanisms, which results in a slowed pivot motion of the front lid. As a result, a user can safely open or close the front lid relative to a back lid, with only minimal force for supporting the front lid.

17 Claims, 8 Drawing Sheets

OPENING AND CLOSING ASSIST FOR A FRONT LID OF A KEYBOARD INSTRUMENT

FIELD OF THE INVENTION

The present invention relates to a front lid opening and closing assist with which a front lid of a keyboard instrument can be opened or closed more easily and safely.

BACKGROUND OF THE INVENTION

As shown in FIG. 8, a keyboard instrument, namely a conventional grand piano 101, is provided with a lid 103 for the purpose of opening a top portion of a piano main body 102 such that acoustic effects can be increased at the time of performance as well as for the purpose of reflecting played sound at a predetermined angle.

The lid 103 comprises a front lid 103*a* and a back lid 103*b*. The front lid 103*a* is pivotably attached, via a hinge 103*c*, to a front edge of the back lid 103*b*, and when the lid 103 is in a closed position, the front lid 103*a* covers a folded-back music stand 104 for protection.

On the other hand, the back lid 103*b* is also pivotably attached, via hinges 105, to the top of a side wall of the piano main body 102 on the lower-key side, and has a plurality of receiving pans 108 and 109 disposed on its rear surface on the higher-key side. The receiving pans 108 and 109 receive and support a tip of either of a plurality of projecting sticks 106 and 107 of different lengths, both of which extend from the piano main body 102 on the higher-key side.

When opening the lid 103 to play the grand piano 101, a user first folds back the front lid 103*a* relative to the back lid 103*b* as shown in FIG. 8, and in this state lifts up the lid 103. The user then selects either of the projecting sticks 106 and 107, and inserts the tip of the selected stick 106 or 107 into its associated receiving pan 108 or 109, thereby supporting and setting the lid 103 in a desired open state.

Now, a problem is the weight of the front lid 103*a*, which is approximately 10 kg. This weight may not be much trouble for a strong man. However, it is sometimes difficult, especially, for women and children, to lift up the front lid 103*a*, and furthermore, it is very dangerous if they pinch their hands in the front lid 103*a* by accidentally dropping it.

SUMMARY OF THE INVENTION

The present invention was made to solve the aforementioned problem. More particularly, the object of the present invention is to provide a front lid opening and closing assist which enables a user to operate a front lid of a keyboard instrument more easily and more safely, at the time of adjusting an open state of the front lid.

In order to attain this object, there is provided a front lid opening and closing assist comprising a buffer to be interposed between a front lid and a back lid constituting a lid of a keyboard instrument, the front lid being pivotably connected to the back lid, for damping pivot motion of the front lid between a closed position where the front lid is level to the back lid, a neutral position where the front lid is perpendicular to the back lid, and an open position where the front lid is superimposed upon the back lid. The buffer comprises a first damping mechanism for damping the front lid when it is pivoted from the neutral position to the closed position, and a second damping mechanism for damping the front lid when it is pivoted from the neutral position to the open position.

According to this structure, in cases where the user opens (lifts up) the front lid relative to the back lid for opening of the entire lid, neither of the first and second damping mechanisms functions while the front lid is pivoted from the closed position to the neutral position. Accordingly, this operation of lifting up the front lid from the closed position is not hindered by those damping mechanisms. Now, in a usual status, once the front lid is pivoted beyond the neutral position, it spontaneously pivots toward the open position because of its own weight. However, this motion is damped by the second damping mechanism, which results in a slow pivot motion of the front lid. As a result, the user can safely superimpose the front lid upon the back lid, with only minimal force for supporting the front lid.

On the other hand, in cases where the user pivots the front lid to the closed position after closing the back lid, neither of the first and second damping mechanisms functions while the front lid is pivoted from the open position to the neutral position. Accordingly, this operation of lifting up the front lid from the open position is not hindered by those damping mechanisms. Now, in a usual status, once the front lid is pivoted beyond the neutral position, it spontaneously pivots toward the closed position because of its own weight. However, this motion is damped by the first damping mechanism, which results in a slow pivot motion of the front lid. As a result, the user can safely close the front lid, with only minimal force for supporting the front lid.

In this manner, when the front lid is laid down from the neutral position to either a closed or open position, the front lid is slowly pivoted because of a damping function of the corresponding damping mechanism. As a result, there is less risk of an accident that the user might catch his/her hand in the front lid by a sudden drop thereof, and further safety is ensured.

As a specific example of the first and second damping mechanisms, each damping mechanism may comprise a rotary damper for applying a rotational resistance within a predetermined range of rotation angles. A rotary damper, for example, a hydraulic-type rotary damper is useable, as described below.

The predetermined range of rotation angles may be set to be approximately 90 degrees from the neutral position to the closed position with respect to the first damping mechanism. Alternatively, it may be set from a position away from the neutral position at a predetermined angle (for example, from 10 to 30 degrees) toward the closed position, such that the first damping mechanism provides no damping force while the front lid is pivoted within the predetermined angle from the neutral position and start to provide a damping force when the front lid is pivoted beyond the predetermined angle toward the closed position. This is possible because the torque applied to the front lid by its own weight is small immediately after the front lid starts to pivot from the neutral position. In this manner, therefore, the pivot motion of the front lid is facilitated, rather than being damped, immediately after the start thereof from the neutral position. The setting of such a range of rotation angles where the damping force is applied to the front lid can be achieved by contriving the structure of the rotary damper, as described below. In the same manner, as to the second damping mechanism, the range of rotation angles may be set to be approximately 90 degrees from the neutral position to the open position, or it may be set such that a damping force is applied only after the front lid is pivoted beyond a predetermined angle from the neutral position toward the open position.

In addition, in view of installation errors, or the like, in fixing the first and second damping mechanisms to the front and back lids, it is also advantageous to set the predetermined range of rotation angles including a spare angle beyond the closed or open position. In this case, damping functions of the rotary dampers are still effective even after the front lid has reached the open or closed position. By this structure, the front lid itself can have some leeway in its pivot angles, and consequently, the front lid can be surely pivoted to a position where it is completely level relative to the back lid.

Also, the rotary damper may be provided with a spring member for applying an urging force which works in the same direction as a direction in which the rotational resistance of the rotary damper acts (that is, a direction in which the front lid is lifted up).

In this structure, if the rotary damper is a hydraulic type, a damping force caused by a spring force can be applied in addition to a damping force caused by a hydraulic pressure. Consequently, the rotary damper can be made relatively small. If the rotary damper is miniaturized, it is inconspicuous when fixed to the front and back lids, which is preferable in view of the appearance of the grand piano.

Also, in cases where the rotary damper is a hydraulic type and provided with the spring member, even when oil leaks are caused by age deterioration of the rotary damper or any other factor, a sudden drop of the front lid can be prevented by a function of the spring member, and safety is further ensured. Moreover, it is possible for the user to judge that the rotary damper has deteriorated when the velocity of pivot motion of the front lid increases. The user can then replace the rotary damper with a new one.

Furthermore, in this case, an urging force applied by the spring member works in a direction in which the front lid is lifted up. Consequently, when the front lid is pivoted from the closed position to the neutral position, or from the open position to the neutral position, the pivot motion of the front lid is facilitated by the urging force of the spring member. As a result, the front lid can be operated more easily, especially, by women and children.

As a specific constitution of the first and second damping mechanisms, each damping mechanism may comprise a first arm to be fixed to the front lid, a second arm to be fixed to the back lid, and a connection for connecting the first and second arms rotatably relative to each other. In this case, the rotary damper is disposed in the connection to damp the rotation of the first and second arms.

If the first and second damping mechanisms have the aforementioned constitution, it is preferable that the first damping mechanism is disposed in the vicinity of one end of the pivot shaft provided between the front and back lids, while the second damping mechanism is disposed in the vicinity of the other end of the pivot shaft between the front and back lids. By this arrangement, both the damping mechanisms are not obstacles to the inner structure of the piano main body. Further in this case, it is preferable for the first arm to have a thickness approximately equal to or smaller than the thickness of the front lid to be fixed into a notch formed on a side edge of the front lid, and for the second arm to have a thickness approximately equal to or smaller than the thickness of the back lid to be fixed into a notch formed on a side edge of the back lid. In this manner, the damping mechanisms can be a part of the front and back lids, thereby making the buffer itself inconspicuous. This is also desirable, especially, in view of appearance.

BRIEF DESCRIPTION OF THE DRAWINGS

The invention will now be described, by way of example, with reference to the accompanying drawings, in which.

DESCRIPTION OF THE PREFERRED EMBODIMENTS

Figure 1:
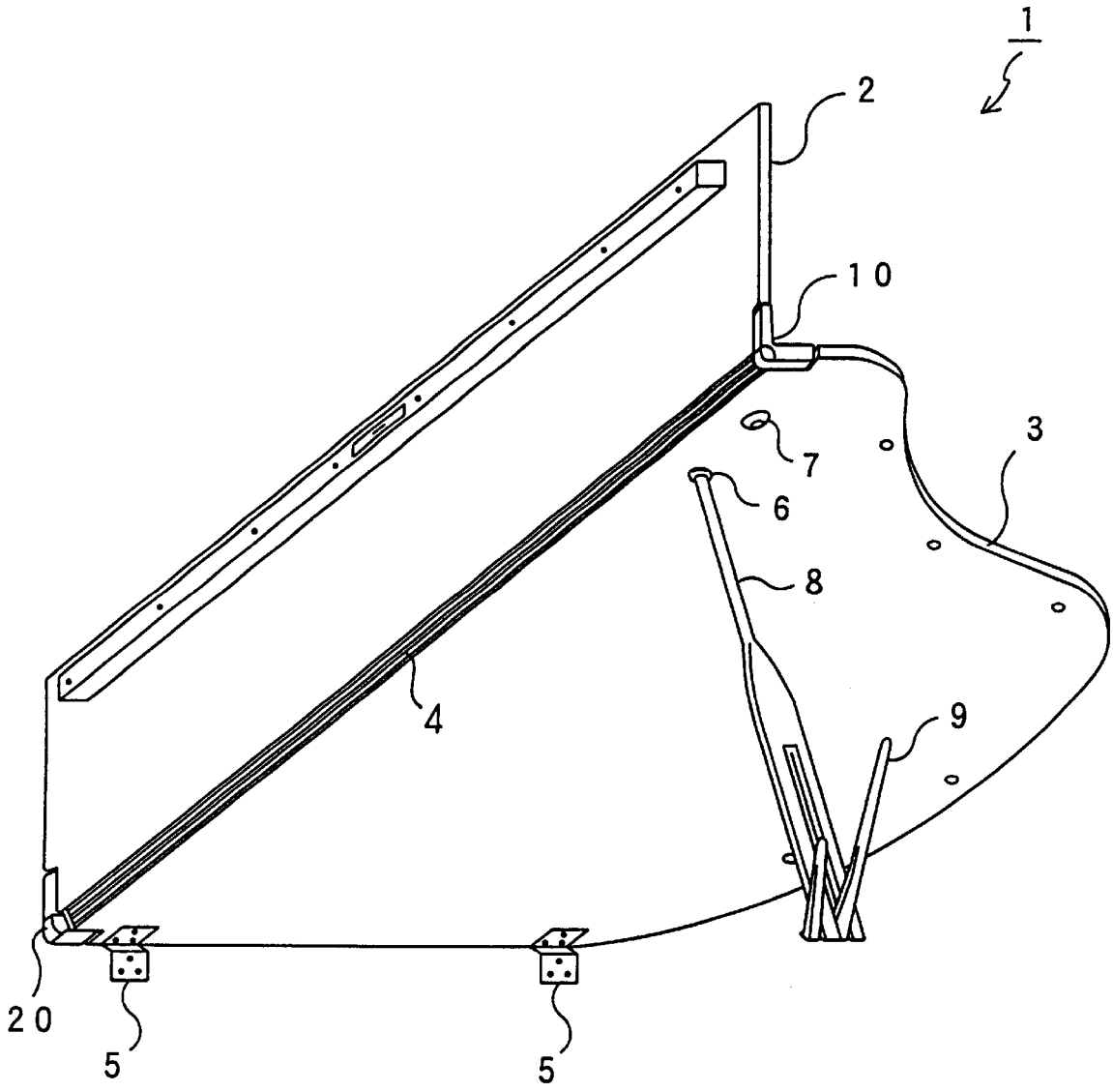
FIG. 1 is a perspective view showing an external appearance of front and back lids of a grand piano having a front lid opening and closing assist according to an embodiment of the invention applied thereto.

As shown in FIG. 1, an entire lid 1 of a grand piano according to an embodiment of the invention comprises a front lid 2 and a back lid 3, as with the conventional lid mentioned above, with the front lid 2 pivotably attached, via a hinge 4, to a front edge of the back lid 3.

The back lid 3 is also pivotably attached, via hinges 5, to a piano main body (not shown) and has a plurality of receiving pans 6 and 7 disposed on its rear surface. The receiving pans 6 and 7 receive and support a tip of either of a plurality of projecting sticks 8 and 9 of different lengths, both extending from the piano main body, thereby allowing the back lid 3 to be retained in a desired open state. Provided in the vicinity of both ends of a pivot shaft between the front lid 2 and back lid 3 are damping mechanisms 10 and 20 as buffers, for damping pivot motion of the front lid 2 within a predetermined range of rotation angles relative to the back lid 3.

Figure 2A:
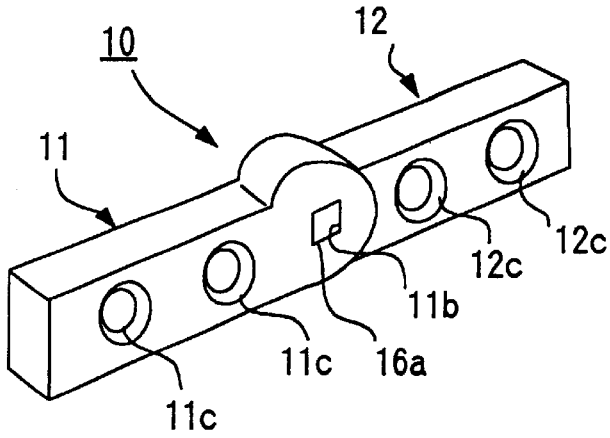
FIGS. 2A and 2B are explanatory views each showing the structure of a buffer according to the embodiment.
Figure 2B:
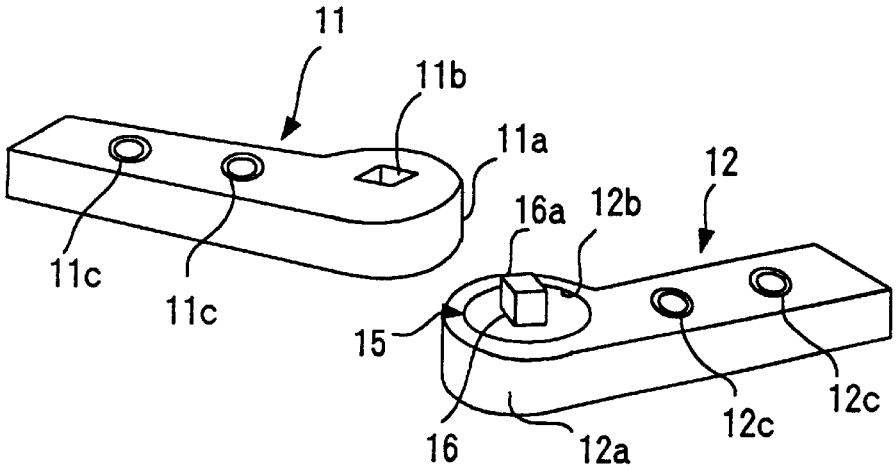
Figure 2C:
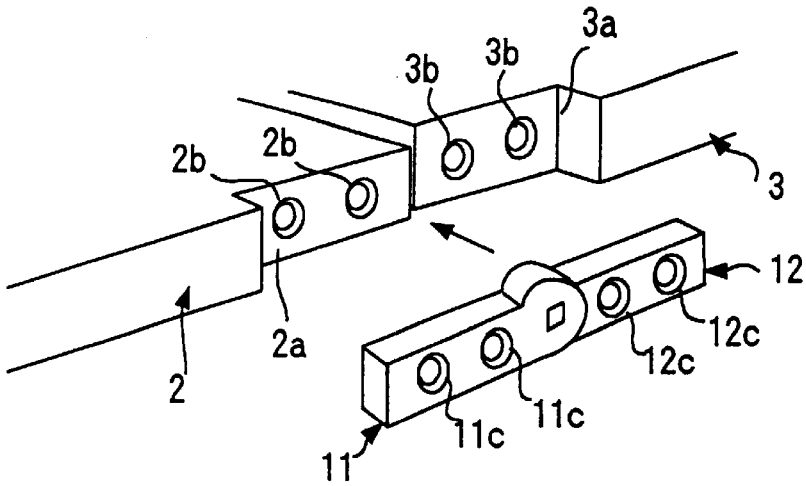
FIG. 2C is an explanatory view showing a fitting structure thereof.

Now, the structure of the damping mechanisms 10 and 20 as well as an attachment structure thereof to the front lid 2 and back lid 3 are described in view of FIGS. 2A to 2C. However, since the damping mechanisms 10 and 20 have the same structure, the structure of the damping mechanism 10 is described in detail and the description of the damping mechanism 20 is not repeated herein. FIG. 2A is an outside view of the damping mechanism 10, FIG. 2B is an exploded view thereof, and FIG. 3C is an explanatory view showing attachment of the damping mechanism 10 to the front lid 2 and the back lid 3.

As shown in FIG. 2A, the damping mechanism 10 comprises a first arm 11 and a second arm 12. Both of these arms have a main part of a rectangular-parallelepiped shape and an end portion of circular shape formed at one end of the main part, with an axis center of the circular end portion deviated from an axis of the main part to a predetermined degree in an upward direction. The first arm 11 and the second arm 12 are rotatably connected to each other at their respective circular end portions, thereby composing the damping mechanism 10. Although the first arm 11 and the second arm 12 are in an open state in FIG. 2A, they can be closed in such a manner that the main parts of both arms overlap each other and are disposed in parallel with each other.

As shown in FIG. 2B, the circular end portion 12*a* of the second arm 12 is provided with a circular groove 12*b* having a predetermined depth in its thickness direction. A cylindrical rotary damper 15 is fitted into the circular groove 12*b*, and a tip 16*a*, having a shape of a rectangular parallelepiped, of a rotation shaft 16 of the rotary damper 15 is perpendicularly extended from a surface of the end portion 12*a* (i.e., a contact surface relative to the first arm 11). Also, the main part of the second arm 12 is penetrated in its thickness direction by two stepped insertion holes 12*c*, through each of which a screw is insertable for securing the second arm 12 to the back lid 3.

On the other hand, the circular end portion 11*a* of the first arm 11 is provided with a polygonal hole 11*b* engageable with the tip 16*a* of the rotation shaft 16 when the first arm 11 is connected to the second arm 12. By engagement of the hole 11*b* and the tip 16*a*, the first arm 11 and the second arm 12 are connected to each other. When the two arms are connected, rotation of the first arm 11 is caused directly by rotation of the rotation shaft 16 of the second arm 12. Also, the main part of the first arm 11 is penetrated in its thickness direction by two stepped insertion holes 11*c*, through each of which a screw is insertable for securing the first arm 11 to the front lid 2.

Figure 3:
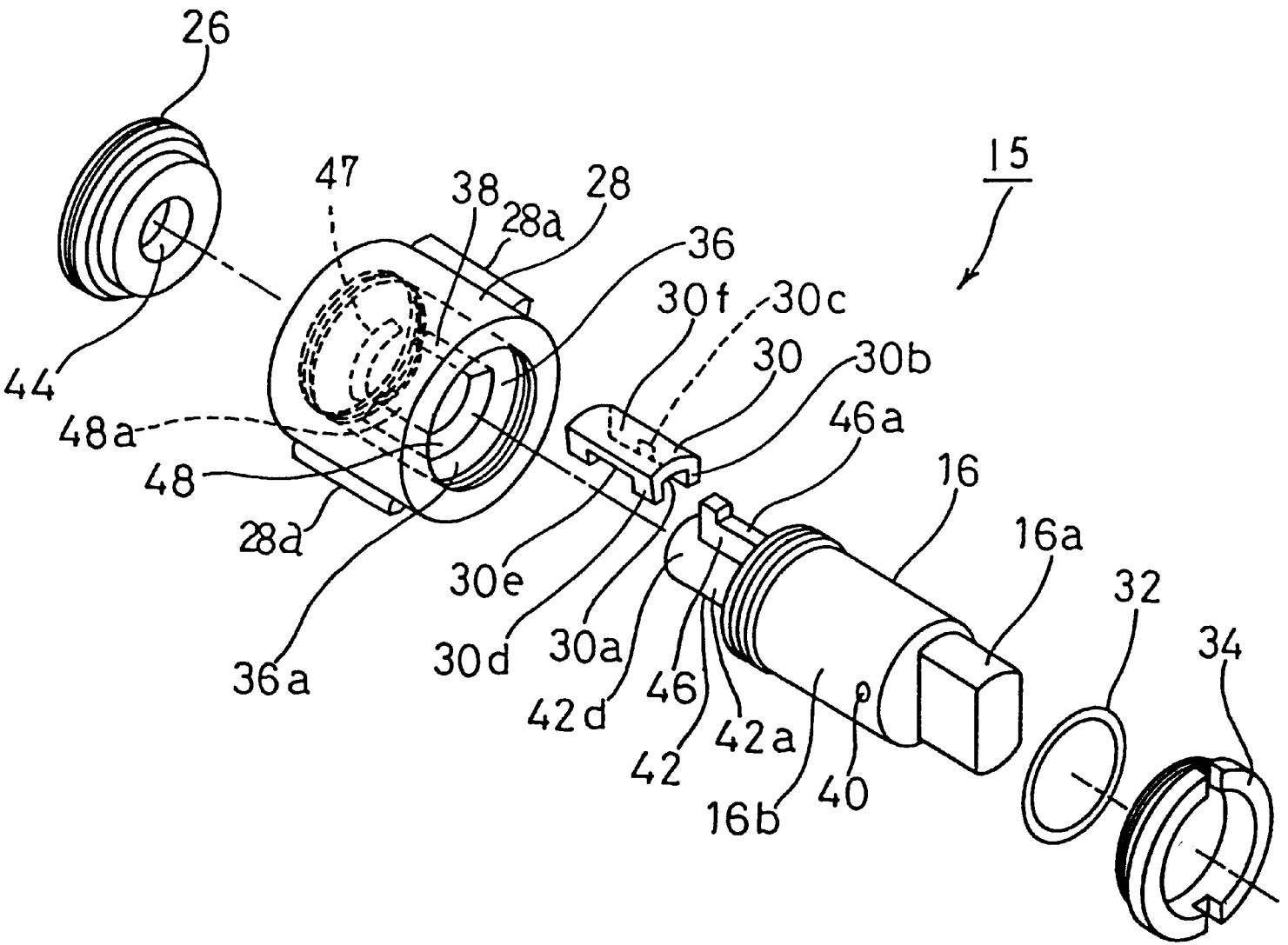
FIG. 3 is an explanatory view showing the structure of a rotary damper according to the embodiment.

As shown in FIG. 3, in which the structure of the rotary damper 15 is illustrated in an exploded perspective view, the rotary damper 15 is a hydraulic-type rotary damper comprising a cap 26, a casing 28, a movable valve 30, the rotation shaft 16, an O-ring 32, a bearing 34 and others. An interior space of the casing 28 is to be filled with a viscous fluid, such as oil.

A shank 42, having a small diameter, is formed prominently from an end of the rotation shaft 16 opposite to the end thereof where the tip 16*a* is provided.

An end portion 42*d* of the shank 42 is rotatably insertable into a bearing recess 44 formed in the center of the cap 26. Provided on a peripheral surface 42*a* of the shank 42 is a protrusion 46 protruding in a radial direction of the shank 42. A part of the protrusion 46 is cut out to form a fluid channel 46*a*.

The movable valve 30 has a U-shaped section, and the protrusion 46 is insertable into a recess 30*a* of the movable valve 30. A fluid channel 30*c*, which is narrow and shallow, is provided on a wall 30*b* surrounding the recess 30*a*, while a fluid channel 30*e*, which is wide and deep, is provided on a wall 30*d* facing the wall 30*b*. Also, a peripheral surface 30*f* of the movable valve 30 is contoured to have a close contact with an interior surface 36*a* of a cylindrical hollow 36 of the casing 28.

On the interior surface 36*a* of the cylindrical hollow 36 of the casing 28, a stopper 48 is prominently extended in an axial direction of the casing 28. An end surface 48*a* of the stopper 48 is contoured to have a close contact with the peripheral surface 42*a* of the shank 42 of the rotation shaft 16. Also, a band-like groove 47 is formed on the interior surface 36*a* to provide a fluid channel for the viscous fluid. On a peripheral surface of the casing 28, two engagement protrusions 28*a* are outwardly protruded for engagement with two engagement recesses (not shown) provided on the circular groove 12*b* of the second arm 12 mentioned above.

In order to assemble the rotary damper 15, one end in an axial direction of the casing 28 is first closed by the cap 26, the viscous fluid is filled into the cylindrical hollow 36 of the casing 28, and then, the movable valve 30 and a part of the rotation shaft 16 are inserted into the cylindrical hollow 36. Subsequently, the O-ring 32 is put around the rotation shaft 16, and the bearing 34 is finally screwed into the cylindrical hollow 36 from an opposite side relative to the cap 26. In this case, the bearing 34 is penetrated by the rotation shaft 16, and the O-ring 32 is pressed into a gap between the rotation shaft 16 and the casing 28.

Figure 4A:
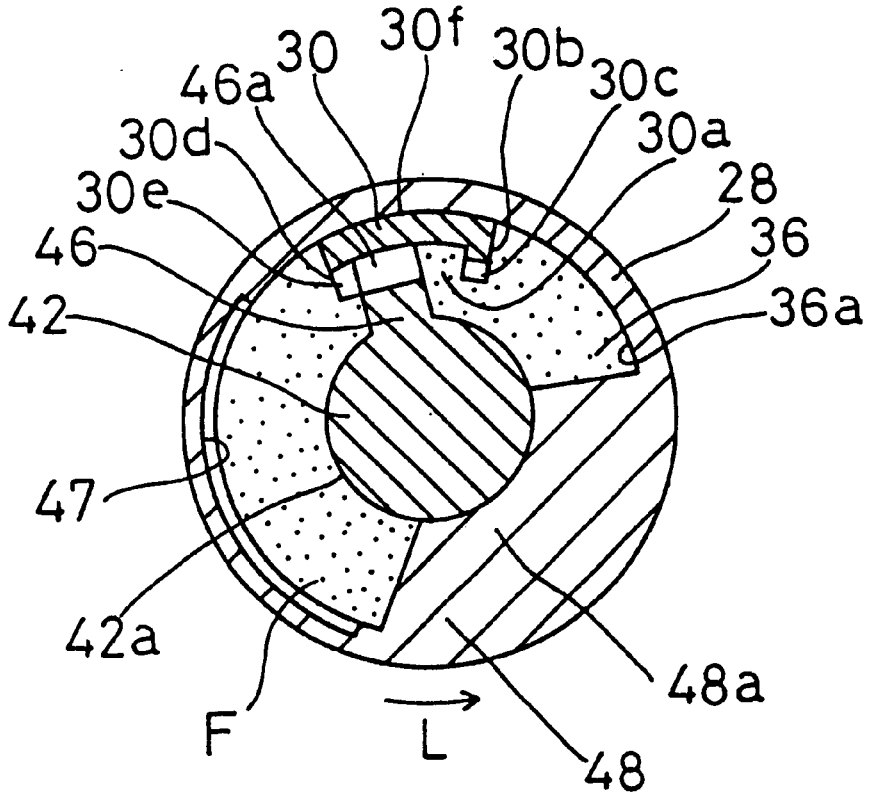
FIGS. 4A and 4B are explanatory cross-sectional views each showing performance of the rotary damper according to the embodiment.
Figure 4B:
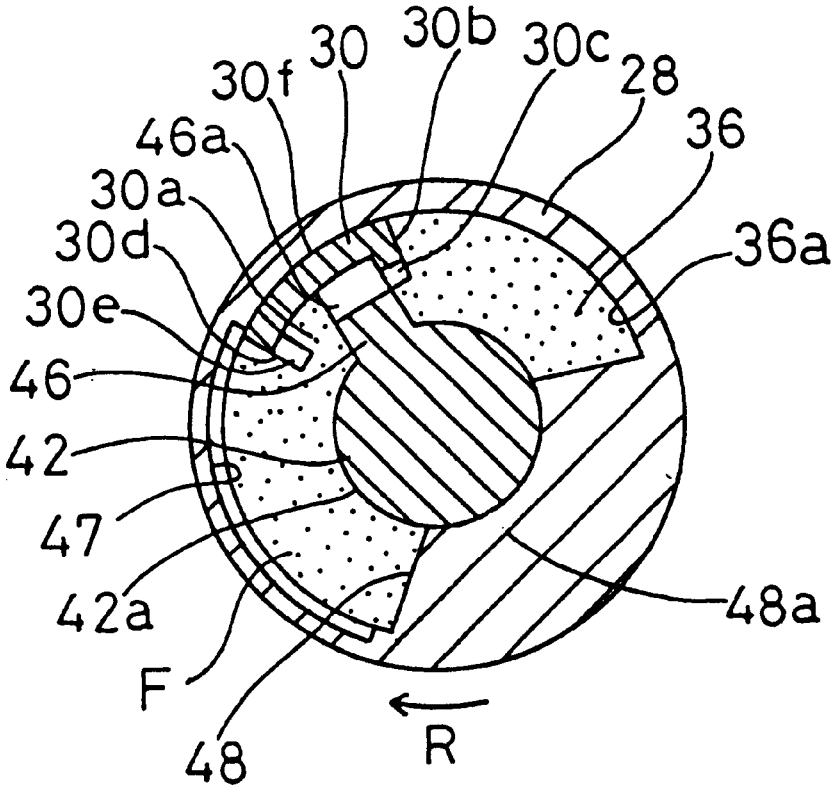

Now, the performance of the rotary damper 15 is described in view of FIGS. 4A and 4B.

As shown in FIG. 4A illustrating a cross section of the aforementioned casing 28, there is provided on the interior surface 36*a* of the casing 28 the stopper 48 having a sectional form of a sector which is outwardly expanded. The band-like groove 47 is extended from a position a little away from a left edge, in FIG. 4A, of the stopper 48. A central angle of the stopper 48 is set to be about 150 degrees, and an extending area of the groove 47 is set to be over about 90 degrees on the basis of a central position of the shank 42.

Because of the aforementioned structure, when the shank 42 is rotated counterclockwise (i.e., in an L direction) within the casing 28, the protrusion 46 is pivoted in the recess 30*a* of the movable valve 30, keeping in contact with an interior surface of the wall 30*d* where the wide and deep fluid channel 30*e* is provided. As a result, a viscous fluid F in the cylindrical hollow 36 flows out of a left area, in FIG. 4A, of the cylindrical hollow 36, passing through the wide and deep fluid channel 30*e* and the fluid channel 46*a* of the protrusion 46, and flows into a right area, in FIG. 4A, of the cylindrical hollow 36 via the recess 30*a*. In this case, all of the fluid channels have sections of sufficient widths and, therefore, the viscous fluid F can flow through the entire passage against a low resistance. Also, when the shank 42 is further rotated in the L direction from the state as shown in FIG. 4A, the viscous fluid F flows out of the left area of the cylindrical hollow 36, via a channel formed between the groove 47 and the peripheral surface 30*f* of the movable valve 30, into the right area of the cylindrical hollow 36. Therefore, rotary motion of the rotation shaft 16 in the L direction is hardly subjected to any resistance.

On the other hand, as shown in FIG. 4B, when the shank 42 is rotated clockwise (i.e., in an R direction) within the casing 28, the protrusion 46 is pivoted keeping in contact with an interior surface of the wall 30*b* where the narrow and shallow fluid channel 30*c* is provided. As a result, the viscous fluid F in the cylindrical hollow 36 flows out of a right area, in FIG. 4B, of the cylindrical hollow 36, passing through the narrow and shallow fluid channel 30*c* and the fluid channel 46*a* of the protrusion 46, and flows into a left area, in FIG. 4B, of the cylindrical hollow 36 via the recess 30*a*. In this case, the narrow and shallow fluid channel 30*c* is a bottleneck having an extremely small section and, therefore, the viscous fluid F is subjected to a high resistance while flowing through the entire passage. Accordingly, rotary motion of the rotation shaft 16 in the R direction is subjected to a high resistance, and a sufficient damping effect is thus produced. However, when the shank 42 is positioned on further left side relative to the position thereof as shown in FIG. 4B, the viscous fluid F can flow out of the right area of the cylindrical hollow 36, through the groove 47 opposed to the peripheral surface 30*f* of the movable valve 30, into the left area of the cylindrical hollow 36. Therefore, in this area (over approximately 90 degrees where the groove 47 is extended), rotary motion of the rotation shaft 16 in the R direction is hardly subjected to any resistance.

By incorporating the rotary damper 15 having the aforementioned structure into the damping mechanisms 10 and 20, damping functions of those damping mechanisms can be effected only when the rotary damper 15 is rotated in a predetermined direction as well as within a predetermined range of rotation angles. In the foregoing example, a damping force acts only when the rotary damper 15 is rotated in the R direction within a range of rotation angles of about 90 degrees in a latter half. However, such a range of rotation angles can be freely set by changing the extending area of the groove 47.

The damping mechanism 10 structured in the aforementioned manner is then interposed between the front lid 2 and the back lid 3 and attached thereto. More specifically, as shown in FIG. 2C, the first arm 11 of the damping mechanism 10 is fixed into a notch 2*a* formed on a side edge of the front lid 2, while the second arm 12 thereof is fixed into a notch 3*a* formed on a side edge of the back lid 3. The fixing of the first arm 11 to the front lid 2 is accomplished by first placing the first arm 11 in such a manner that two stepped insertion holes 11*c* of the first arm 11 are opposedly aligned to two screw insertion holes 2*b* formed on the notch 2*a* of the front lid 2, and then inserting two screws, respectively, into one of the stepped insertion holes 11*c* and one of the opposedly aligned screw insertion holes 2*b*. In the same manner, the second arm 12 is screwed to the back lid 3 by first placing the second arm 12 in such a manner that two stepped insertion holes 12*c* of the second arm 12 are opposedly aligned to two screw insertion holes 3*b* formed on the notch 3*a* of the back lid 3, and then inserting two screws, respectively, into one of the stepped insertion holes 12*c* and one of the opposedly aligned screw insertion holes 3*b*.

Hereinafter, the operation of a front lid opening and closing assist according to the embodiment is described in view of FIG. 5.

Figure 5:
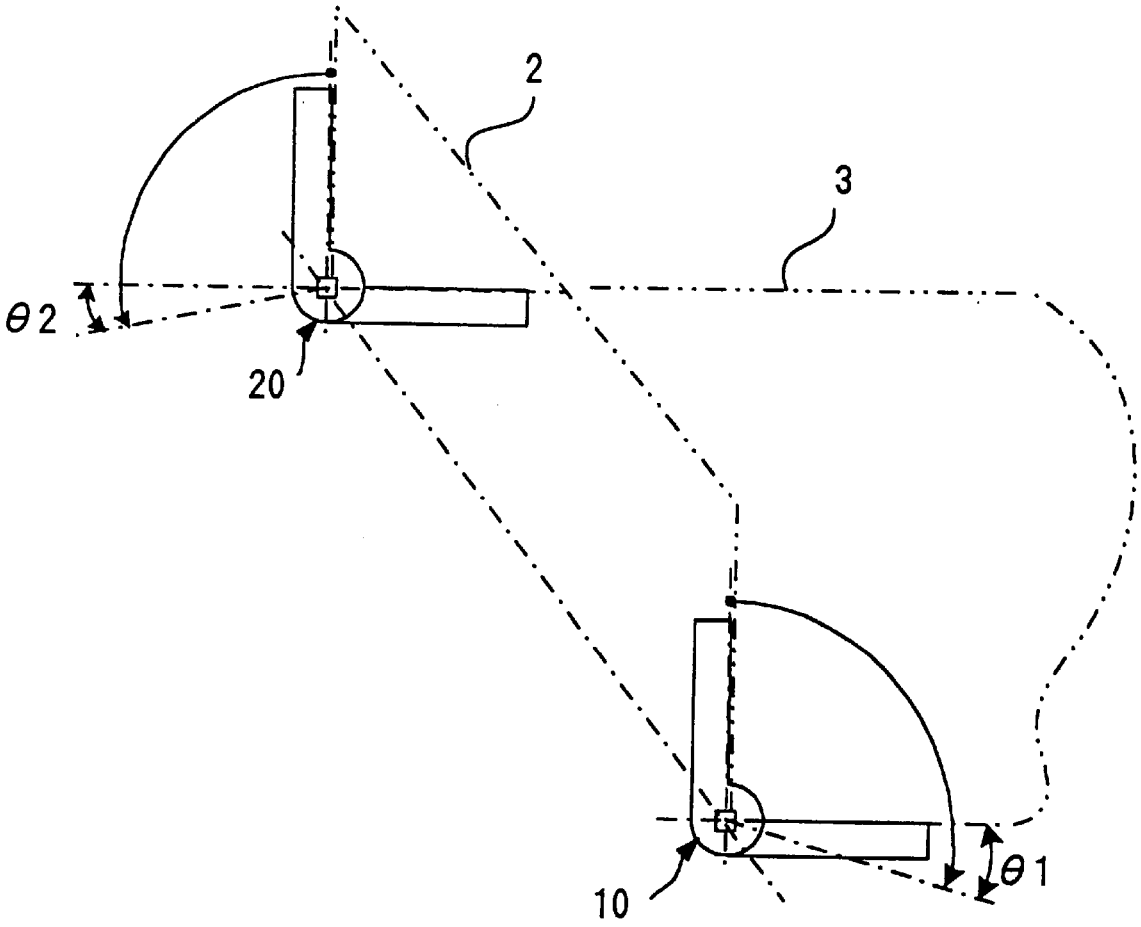
FIG. 5 is an explanatory elevation view showing performance of the front lid opening and closing assist according to the embodiment.

As conceptually shown in FIG. 5, the damping mechanisms 10 and 20, both interposed between and attached to the front lid 2 and the back lid 3 in the aforementioned manner, have their respective operating angles set.

More specifically, the pivot motion of the front lid 2 is damped by the damping mechanisms 10 and 20 between a closed position where the front lid 2 is level to the back lid 3, a neutral position where the front lid 2 is perpendicular to the back lid 3, and an open position where the front lid 2 is superimposed upon the back lid 3, thereby preventing a sudden drop of the front lid 2. The damping mechanisms 10 and 20 have different damping ranges as well as different damping directions set for each. That is, as shown in FIG. 5 by means of arrows indicating an operating range of each damping mechanism, when the front lid 2 is pivoted from the neutral position to the open position, the pivot motion of the front lid 2 is damped by the damping mechanism 10, and when the front lid 2 is pivoted from the neutral position to the closed position, the pivot motion of the front lid 2 is damped by the damping mechanism 20.

According to this structure, when a user opens (lifts up) the front lid 2 relative to the back lid 3, damping functions of the damping mechanisms 10 and 20 do not work while the front lid 2 is pivoted from the closed position to the neutral position. Therefore, neither of the damping mechanisms 10 and 20 hinders the user from opening the front lid 2 from its closed position to its neutral position. Then, if the front lid 2 is pivoted beyond the neutral position, it spontaneously pivots toward the open position because of its own weight, however, this motion is damped by the damping mechanism 10, which results in a slow pivot motion of the front lid 2. As a result, the user can safely superimpose the front lid 2 upon the back lid 3, with only minimal force for supporting the front lid 2.

On the other hand, when the user closes the front lid 2 relative to the back lid 3, damping functions of the damping mechanisms 10 and 20 do not work while the front lid 2 is pivoted from the open position to the neutral position. Therefore, neither of the damping mechanisms 10 and 20 hinders the user from lifting the front lid 2 up from its open position to its neutral position. Then, if the front lid 2 is pivoted beyond the neutral position, it spontaneously pivots toward the closed position because of its own weight, however, this motion is damped by the damping mechanism 20, which results in a slow pivot motion of the front lid 2. As a result, the user can safely close the front lid 2, only by supporting the front lid 2 with minimal force.

As mentioned above, when the front lid 2 is laid down from the neutral position to either closed or open position, a damping function of the corresponding damping mechanism 10 or 20 is exercised, and because of this damping function, the front lid 2 pivots slowly from the neutral position to the open position, or from the neutral position to the closed position. As a result, a risk that the user might catch his/her hand in the front lid 2 by accidentally dropping it is reduced, and safe operation of the front lid 2 can be ensured.

According to the present embodiment, however, the damping ranges of the damping mechanisms 10 and 20 are set to be a little greater than 90 degrees, in view of fixing errors in fixing the damping mechanisms 10 and 20 to the front lid 2 and the back lid 3, or the like. Specifically, the damping ranges of the damping mechanisms 10 and 20 involve an angle of 90 degrees plus spare angles □1 and □2, respectively.

A preferred embodiment of the present invention has been described above; however, the present invention is, of course, not restricted to this embodiment and may be practiced or embodied in still other ways without departing from the subject matter thereof.

Figure 6A:
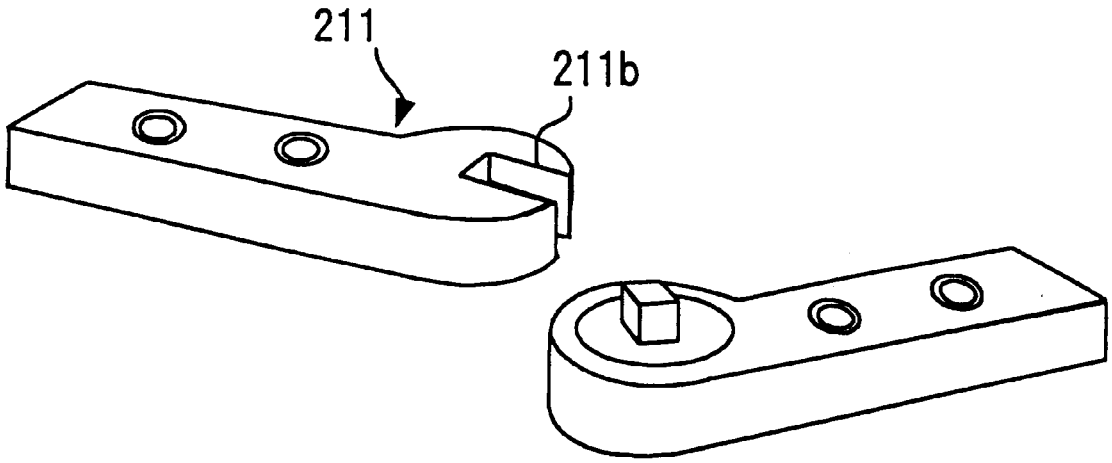
FIGS. 6A and 6B are explanatory views each showing a modified structure of the buffer.

In the above-described embodiment, for example, as one mode of composing the damping mechanism 10, provided on the side of the first arm 11 is the hole 11*b* having a shape corresponding to that of the tip 16*a* of the rotation shaft 16 on the side of the second arm 12; however, as shown in FIG. 6A, a hole 211*b* opening to an end of a first arm 211 may be provided instead of the hole 11*b*. The hole 211*b* can be formed simply by cutting out a part of the first arm 211 from its end portion, and a forming process of the hole 211*b* is thus simplified to some degree, compared to a forming process of the hole 11*b*.

Figure 6B:
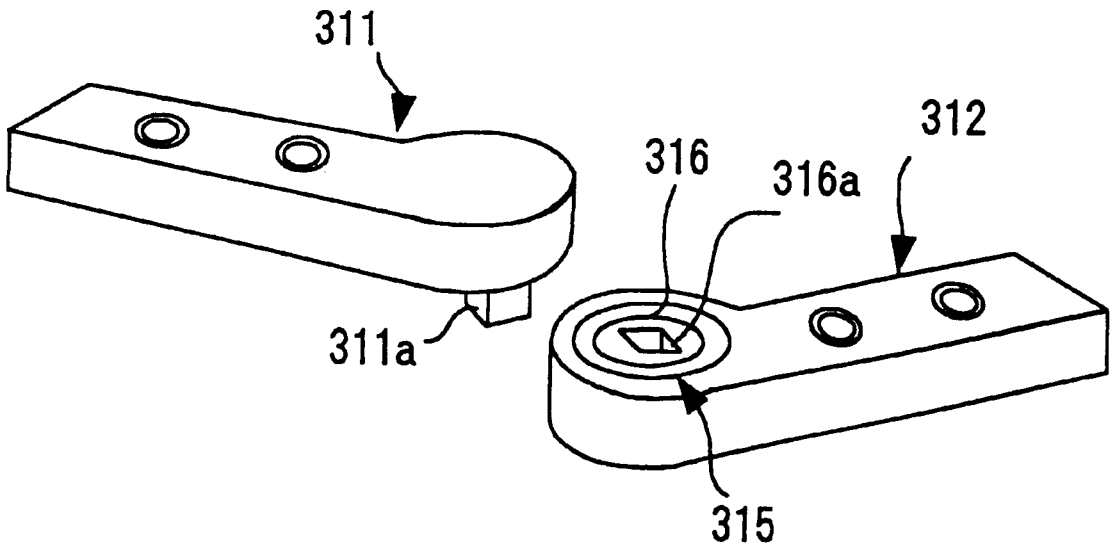

Alternatively, as shown in FIG. 6B, an engagement protrusion 311*a* may be provided on the side of a first arm 311, while an engagement recess 316*a* may be formed on a rotation shaft 316 of a rotary damper 315 on the side of a second arm 312. From among these and other modes, any preferable mode of joining the first and second arms may be selected in view of convenience in design.

Figure 7:
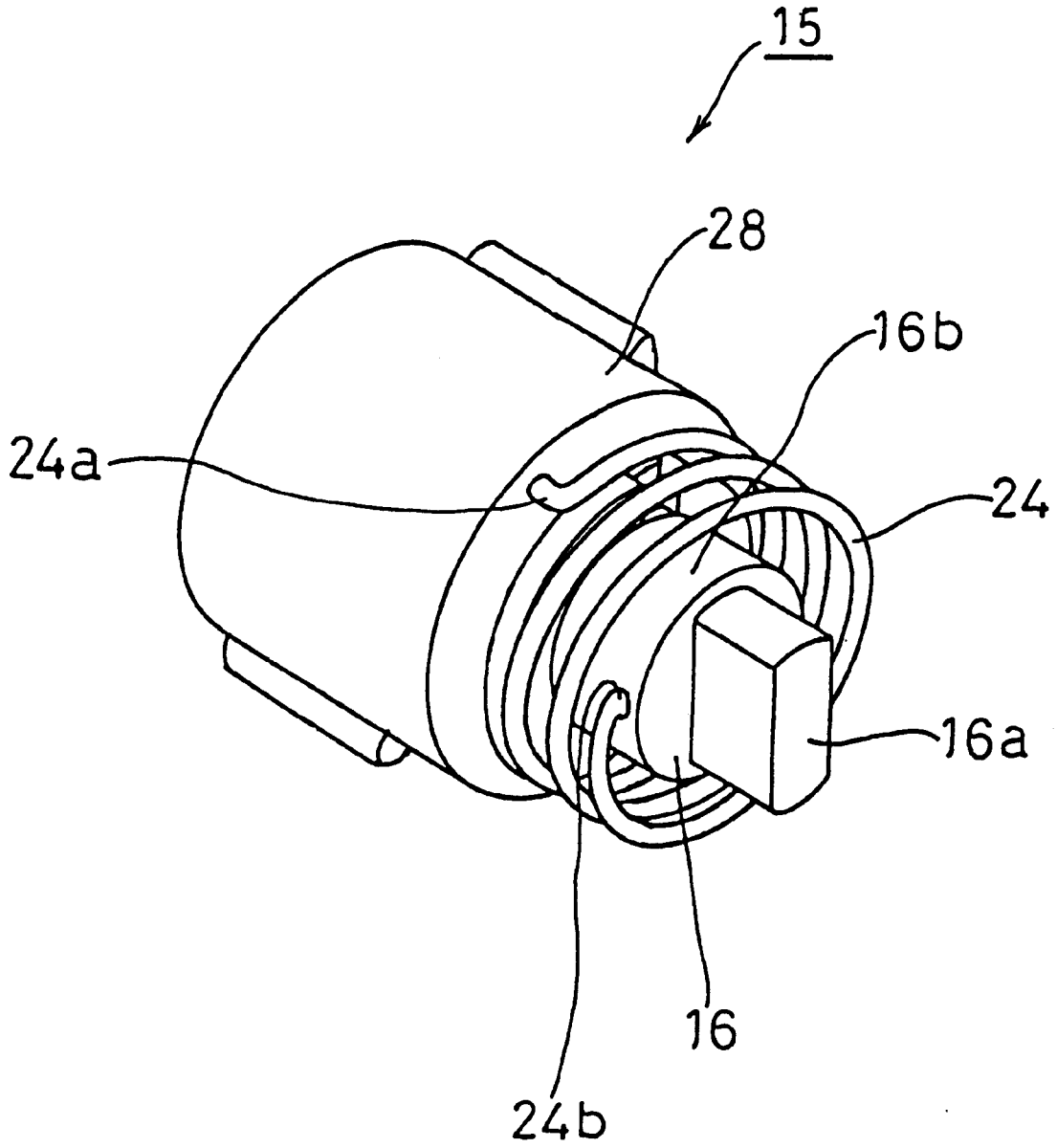
FIG. 7 is an explanatory view showing a modified structure of the rotary damper.
Figure 8:
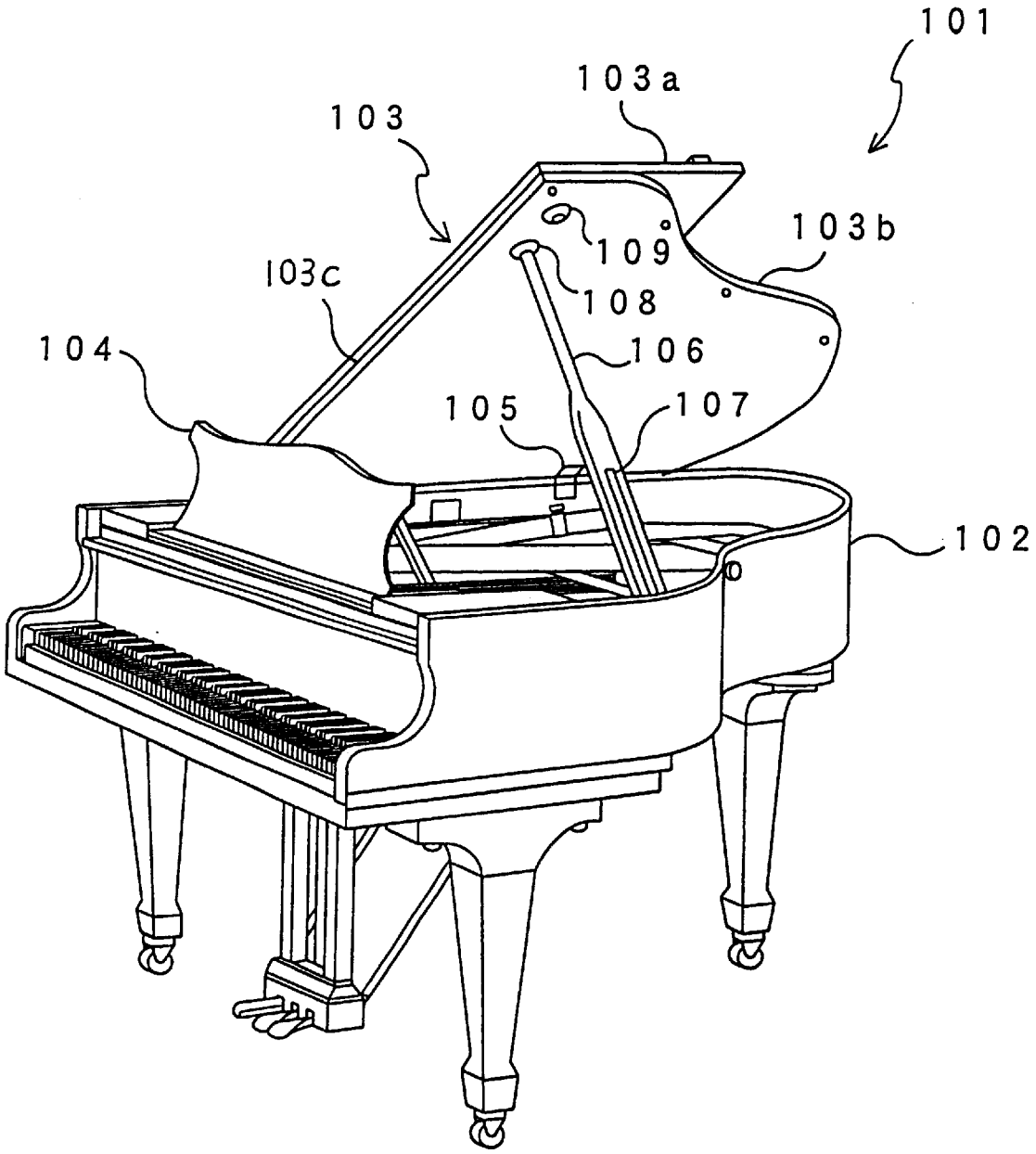
FIG.8 PRIOR ART
FIG. 8 is a perspective view showing an external appearance of a conventional grand piano.

Also, in the above-described embodiment, the rotary damper 15 is composed of a hydraulic mechanism only; however, as shown in FIG. 7, it may also be provided with a coil spring (spring member) 24 for applying an urging force which works in the same direction as an active direction of the rotational resistance of the rotary damper 15. In this case, the coil spring 24 is fixed to the casing 28 at its one end 24*a*, and to an end portion 16*b* of the rotation shaft 16 at the other end 24*b* thereof. Because of this structure, the rotation shaft 16 is urged by the coil spring 24 in one direction.

By adopting this structure in the rotary damper 15, a relatively small rotary damper of a hydraulic or any other type can be employed to achieve the same effects as described above in opening and closing operations of the front lid 2. In other words, the rotary damper 15 can be miniaturized if provided with a spring member. And if the rotary damper 15 is miniaturized, it is inconspicuous when attached to the front lid 2 and the back lid 3, which is preferable in view of appearance.

Also, if the hydraulic-type rotary damper 15 is provided with the coil spring 24, even when oil leaks are caused by age deterioration of the rotary damper 15 or any other factor, a sudden drop of the front lid 2 can be prevented by a function of the coil spring 24, and safety is further ensured. Also, it is possible for the user to judge that the rotary damper 15 has been deteriorated with an increased velocity of pivot motion of the front lid 2. The user can then replace the rotary damper 15 with a new one.

Furthermore, in this case, an urging force applied by the coil spring 24 works in a direction in which the front lid 2 is lifted up. Consequently, when the front lid 2 is pivoted from the closed position to the neutral position, or from the open position to the neutral position, the pivot motion of the front lid 2 is facilitated by the urging force of the coil spring 24. As a result, the front lid 2 can be operated more easily, which would be appreciated, especially, by women and children.

What is claimed is:

1. An opening and closing assist device for assisting in the opening and closing of a lid of a keyboard instrument, the opening and closing assist device comprising:

first and second lid portions pivotably connected such that the lid has a closed position, an opened position and an intermediate neutral position;

a damping mechanism for selectively damping relative pivotable motion between the first and second portions when the lid is pivoted from the closed position to the opened position and when the lid is pivoted from the opened position to the closed position, the damping mechanism, when pivoting the lid from the closed position to the opened position, being inactive during lid motion from the closed position to the neutral position while providing damping for the lid during lid motion from the neutral position to the opened position, and the damping mechanism, when pivoting the lid from the opened position to the closed position, being inactive during lid motion from the opened position to the neutral position while providing damping for the lid during lid motion from the neutral position to the closed position.

2. The opening and closing assist device according to claim 1, wherein the damping mechanism comprises at least a rotary damper for applying a rotational resistance within at least a predetermined range of rotation.

3. The opening and closing assist device according to claim 2, wherein the rotary damper applies a rotational resistance within first and second ranges of rotation.

4. The opening and closing assist device according to claim 2, wherein the rotary damper applies a rotational resistance within a first range of rotation and an opposing rotational resistance within a second range of rotation.

5. The opening and closing assist device according to claim 1, wherein the damping mechanism comprises a first damping mechanism for damping relative pivotable motion between the first and second portions when the lid is pivoted from the neutral position to the closed position, and a second damping mechanism for damping relative pivotable motion between the first and second portions when the lid is pivoted from the neutral position to the opened position.

6. The opening and closing assist device according to claim 5, wherein in the closed position the first and second portions of the lid are substantially planarly aligned, in the neutral position the first and second portions are substantially perpendicular and in the opened position one of the first and second portions is superimposed upon and substantially supported by the other portion.

7. The opening and closing assist device according to claim 5, wherein the first and second damping mechanisms comprise respective first and second rotary dampers for applying a rotational resistance within a predetermined range of rotation.

8. The opening and closing assist device according to claim 7, wherein the first and second rotary dampers of the first and second damping mechanisms are provided with opposing rotational resistance within a respective first and second predetermined ranges of rotation.

9. The opening and closing assist device according to claim 8, wherein each rotary damper is provided with a spring member for applying an urging force which works in the same direction as a direction in which the rotational resistance acts.

10. The opening and closing assist device according to claim 1, further comprising a first arm to be fixed to the first portion, a second arm to be fixed to the second portion, the first and second arms each having a free end and a connected end, wherein the connected ends are joined to form a pivot for rotatably connecting the first and second arms relative to each other, and the damping mechanism is disposed in the pivot to at least partially inhibit rotation between the first and second arms.

11. The opening and closing assist device according to claim 10, wherein thee connected end of the first arm comprises a first damping mechanism for damping relative pivotable motion between the first and second portions within a first range of rotation, when the lid is pivoted from the neutral position to the closed position, and the connected end of the second arm comprises a second damping mechanism for damping relative pivotable motion between the first and second portions within a second range of rotation, when the lid is pivoted from the neutral position to the opened position.

12. The opening and closing assist device according to claim 11, wherein the first damping mechanism damps relative rotational motion between the first and second portions in a first rotational direction and the second damping mechanism damps relative rotational motion between the first and second portions in a second opposing rotational direction.

13. The opening and closing assist device according to claim 10, wherein the first damping mechanism is disposed in the vicinity of one end of a pivot axis provided between the first and second portions, the second damping mechanism is disposed in the vicinity of the other end of the pivot axis between the first and second portions, tie first arm has a thickness approximately equal to or smaller than a thickness of the first portion to be fixed into a first notch formed on a side edge of the find portion, and the second arm has a thickness approximately equal to or smaller than a thickness of the second portion to be fixed into a second notch formed on a side edge of the second portion.

14. An opening and closing assist device for damping rotational force developed between pivotably connected first and second elements, the opening and closing assist device comprising:

first and second arms having respective first and second connected ends defining a pivot point about which respective first and second free ends of the first and second arms are rotatable;

a first position defined by the free ends of the first and second arms being linearly opposed from one another;

a second position defined by the free ends of the first and second arms being lineally adjacent to one another;

an intermediate position defined by the free ends of the first and second arms being substantially perpendicular to one another; and a damping mechanism for damping relative pivotable motion in a first rotational direction between the first position and the intermediate position and for damping relative pivotable motion in a second rotational direction between the intermediate position and the second position.

15. The opening and closing assist device according to claim 14, wherein the damping mechanism is a hydraulic rotary damper.

16. The opening and closing assist device according to claim 15, wherein the hydraulic rotary damper further comprises at least a spring member for urging the hydraulic rotary damper in at least one of the first and second rotational directions.

17. A method of providing assistance to a user with opening and closing of a lid of a keyboard instrument, the method comprising the steps of:

interposing an opening and closing assist device between a first portion and a second portion of the lid to pivotably connect the first and second portions and provide damping of pivot motion between the first portion and the second portion;

providing the opening and closing assist device with a damping mechanism;

defining the first and second portions of the lid as having a closed position, an opened position and an intermediate neutral position;

providing a damping mechanism for selectively damping relative pivotable motion between the first and second portions when the lid is pivoted from the closed position to the opened position and when the lid is pivoted from the opened position to the closed position, the damping mechanism, when pivoting the lid from the closed position to the opened position, being inactive during lid motion from the closed position to the neutral position while providing damping for the lid during lid motion from the neutral position to the opened position;

the damping mechanism, when pivoting the lid from the opened position to the closed position, being inactive during lid motion from the opened position to the neutral position while providing damping for the lid during lid motion from the neutral position to the closed position; and hydraulically damping relative pivotable motion between the first and second portions when the lid is pivoted from the neutral position to the closed position, and when the lid is pivoted from the neutral position to the opened position.

* * * * *